US007690632B2

(12) United States Patent
Izumichi et al.

(10) Patent No.: US 7,690,632 B2
(45) Date of Patent: Apr. 6, 2010

(54) SHEET BENDING APPARATUS AND SHEET POSTPROCESSING APPARATUS

(75) Inventors: Sachio Izumichi, Osaka (JP); Mitsutoshi Takemoto, Osaka (JP); Takashi Kotani, Osaka (JP); Terumitsu Noso, Osaka (JP)

(73) Assignee: Kyocera Mita Corporation (JP)

( * ) Notice: Subject to any disclaimer, the term of this patent is extended or adjusted under 35 U.S.C. 154(b) by 565 days.

(21) Appl. No.: 11/604,437

(22) Filed: Nov. 27, 2006

(65) Prior Publication Data

US 2007/0120307 A1 May 31, 2007

(30) Foreign Application Priority Data

Nov. 30, 2005 (JP) ..... 2005-345701

(51) Int. Cl.
*B65H 37/04* (2006.01)

(52) U.S. Cl. ..... 270/37; 270/32; 270/58.07; 270/58.12; 270/58.17; 270/58.27; 270/45; 270/51; 270/20.1; 493/424; 493/434; 493/435; 493/445

(58) Field of Classification Search ..... 270/20.1, 270/32, 37, 45, 51, 58.07, 58.12, 58.17, 58.27; 493/424, 434, 435, 445
See application file for complete search history.

(56) References Cited

U.S. PATENT DOCUMENTS 3,926,425 A 12/1975 Pierce et al.
4,047,711 A 9/1977 Gregoire et al.
5,501,442 A * 3/1996 Mandel ..... 270/58.07
5,555,082 A 9/1996 Tanaka et al.
5,749,822 A 5/1998 Ellsworth et al.
6,074,332 A 6/2000 Helmstadter et al.
6,276,677 B1 * 8/2001 Hommochi et al. ..... 270/32
6,921,069 B2 * 7/2005 Suzuki et al. ..... 271/207
6,997,449 B2 2/2006 Obuchi et al.
7,018,507 B2 3/2006 Hsieh
7,111,837 B2 9/2006 Itou et al.
7,203,454 B2 4/2007 Terao et al.
2004/0183246 A1 * 9/2004 Jung et al. ..... 270/37

FOREIGN PATENT DOCUMENTS

JP 2002-167120 6/2002

* cited by examiner

*Primary Examiner*—Gene Crawford
*Assistant Examiner*—Leslie A Nicholson, III
(74) *Attorney, Agent, or Firm*—Gerald E. Hespos; Anthony J. Casella

(57) ABSTRACT

A sheet bending apparatus and a sheet postprocessing apparatus are provided for improved alignment of recording sheets during center-folding. A center-folding unit mounted in a sheet postprocessing apparatus performs a center-folding processing to a stack of recording sheets aligned on their sides and placed in a sheet holding member. Side aligning is performed near a central portion in a sheet conveyance direction of the sheet holding member. The center-folding unit includes: two upper end aligning members positioned upstream in the sheet conveyance direction on the sheet holding member and movable equally in opposite width directions of the sheet holding member; and a pair of lower side end aligning members positioned on downstream in the sheet conveyance direction on the sheet holding member and are movable equally in opposite width directions of the sheet holding member and independently from the upper end aligning members.

7 Claims, 9 Drawing Sheets

SHEET BENDING APPARATUS AND SHEET POSTPROCESSING APPARATUS

BACKGROUND OF THE INVENTION

1. Field of the Invention

The present invention relates to a sheet bending apparatus for performing a center-bending processing to a recording sheet to which a predetermined processing has been performed previously by an upstream device such as an image forming apparatus and discharging the same, and a sheet postprocessing apparatus.

2. Description of the Related Art

Generally, in a case where a side end aligning and a obliqueness correction is performed to a recording sheet placed in a sheet holding member by using a pair of side end aligning members, it is preferable that the side end aligning members have a length long enough to cover a substantially entire length of the sheet holding member.

However, since the center-folding apparatus is provided with bending rollers and a bending blade each having a length covering a full width of the sheet holding member and positioned at a central portion thereof, the side end aligning members are likely to be provided respectively on upstream and downstream in a sheet conveyance direction and formed integrally with the side end aligning members on upstream and downstream so as to stride across the bending rollers and the bending blade.

However, the integrally formed side end aligning members include the ones on upstream are supported respectively by the other ones on downstream in a cantilever state. Accordingly, the side end aligning and the obliqueness correction are substantially performed only on downstream. Consequently, an effect of the side end aligning and the obliqueness correction performed on upstream is not considered to be sufficient. The reason is as follows. Namely, after a recording sheet is placed in the sheet holding member, a frictional resistance generated between the recording sheet and the sheet holding member becomes great, and a great force is required to overcome the frictional resistance and to move the recording sheet with the side end aligning members. For example, if such a great force is applied to a recording sheet which is so thin, there is likelihood causing the recording sheet to be deformed.

In this regard, a frictional resistance generated between the recording sheet and the sheet holding member becomes small during when the recording sheet is in course of being conveyed into the sheet holding member. Accordingly, a small force would be enough for overcoming the small frictional resistance and moving the recording sheet in opposite width directions using the side end aligning members. Consequently, if such a small force is applied to a thin recording sheet and the like, the recording sheet would be less likely to be deformed.

Thus, in the side end aligning and the obliqueness correction performed to the recording sheet using the side end aligning members, it is more advantageous to perform the side end aligning and the obliqueness correction by the side end aligning members on upstream with which a recording sheet comes in contact when the recording sheet is in course of being conveyed into the recording sheet holding member rather than performing the same by the side end aligning members on downstream with which a recording sheet comes in contact after the recording sheet is placed in the holding member.

In this regard, the Japanese Unexamined Patent Publication No. 2002-167120, for example, discloses a pair of side end aligning members provided on opposite side ends and positioned only on upstream from a sheet bending member in a sheet conveyance passage.

However, even though it is more advantageous to perform the side end aligning and the obliqueness correction by using the side end aligning members provided on upstream with which a recording sheet comes in contact when the recording sheet is in course of being conveyed into the recording sheet holding member than performing the same by using the side end aligning members provided on downstream with which a recording sheet comes in contact after the recording sheet is placed in the holding member, if the pair of side end aligning members are positioned only on upstream from the sheet bending member as disclosed in the prior art, an effect of the side end aligning and the obliqueness correction on downstream would not be sufficient since the side end aligning and the obliqueness correction are performed only on upstream. Thus, an alignment of side ends of recording sheets at the time of performing the center-folding processing could not be enhanced in this case.

SUMMARY OF THE INVENTION

The present invention was made in view of the above-described circumstance, and its object is to provide a sheet bending apparatus capable of enhancing an alignment of side ends of recording sheets at the time of performing the center-folding processing and a sheet postprocessing apparatus.

A sheet bending apparatus according to one aspect of the present invention includes a sheet bending apparatus for performing a center-folding processing to a stack of a plurality of recording sheets which are placed in a sheet holding member and whose both side ends are aligned, the center-folding processing being performed in a vicinity of a central portion in a sheet conveyance direction of the sheet holding member, the sheet bending apparatus including: a pair of upper side end aligning members positioned on upstream in the sheet conveyance direction on the sheet holding member and being movable equally in opposite width directions of the sheet holding member; a pair of lower side end aligning members positioned on downstream in the sheet conveyance direction on the sheet holding member and being movable equally in opposite width directions of the sheet holding member and independently from the upper side end aligning members.

According to this construction, a pair of upper side end aligning members being movable equally in opposite width directions of the sheet holding member are positioned on upstream in the sheet conveyance direction on the sheet holding member, and a pair of lower side end aligning members movable equally in opposite width directions of the sheet holding member and independently from the upper side end aligning members are positioned on downstream in the sheet conveyance direction on the sheet holding member.

Thus, operations of both members taking in consideration of a difference between a timing at which the upper side end aligning members come in contact with a recording sheet and a timing at which the lower side end aligning members come in contact with the recording sheet can be performed. Accordingly, the side end aligning and the obliqueness correction can be assuredly performed both on upstream and downstream in the sheet conveyance direction on the sheet holding member. Accordingly, the alignment of the recording sheets at the time of the center-folding processing can be enhanced.

These and other objects, features, aspects, and advantages of the present invention will become more apparent from the following detailed description of the preferred embodiments/examples with reference to the accompanying drawings.

DETAILED DESCRIPTION OF THE PREFERRED EMBODIMENTS

Hereinafter, an embodiment of the present invention is described with reference to the attached drawings. It should be noted that the following embodiment is merely an example which embodies the present invention and has no nature of limiting the scope of the present invention.

Figure 1:
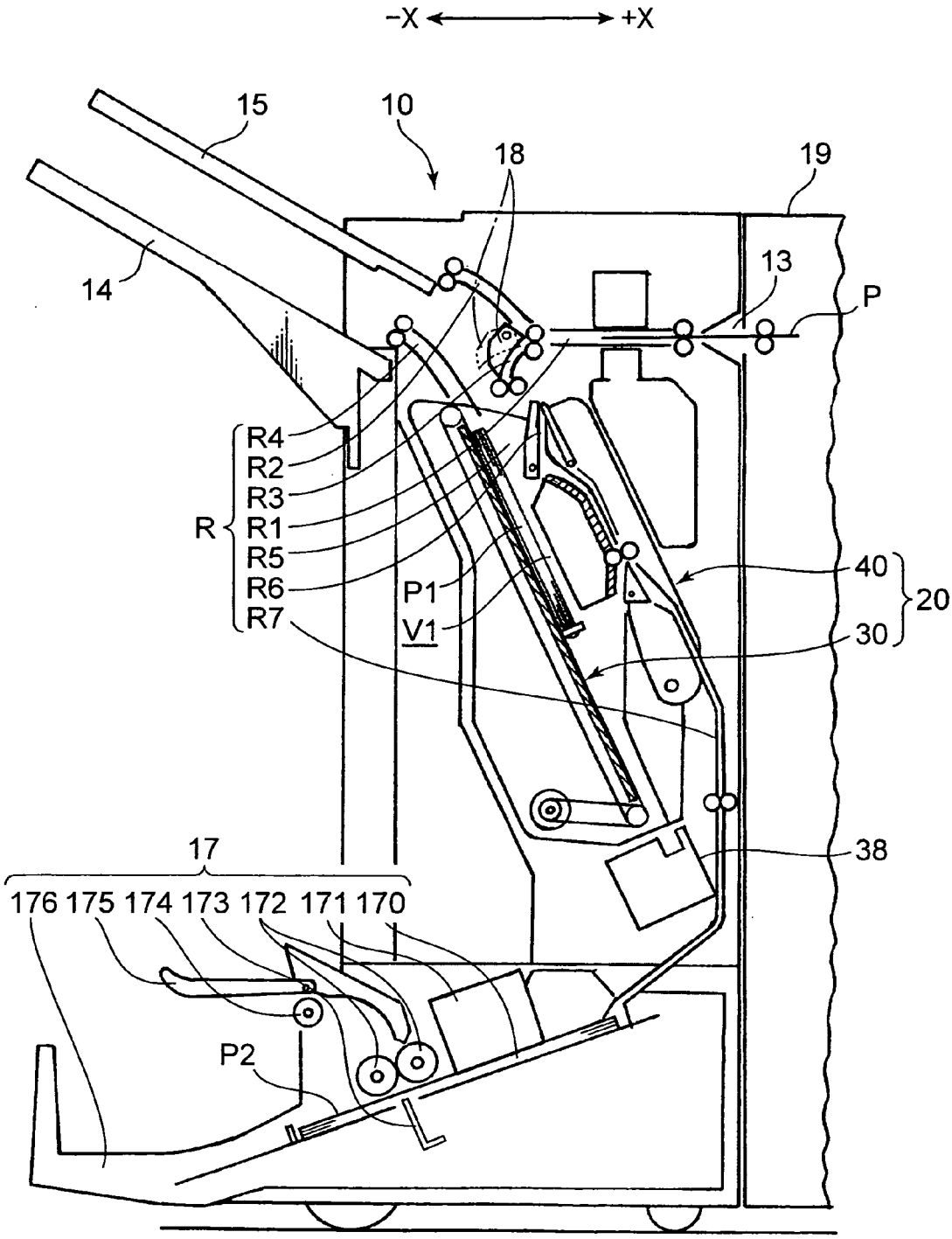
FIG. 1 is a front sectional view showing a schematic construction of a sheet postprocessing apparatus in which a center-folding unit according to an embodiment of the present invention is mounted.

FIG. 1 is a front sectional view showing a schematic construction of a sheet postprocessing apparatus 10 according to an embodiment of the present invention. It should be noted that +X and −X in the figure denote the right side and the left side respectively. As shown in FIG. 1, in the sheet postprocessing apparatus 10, a sheet conveyance passage R is provided for conveying a recording sheet P which is to be conveyed from an image forming apparatus 19 to respective portions in accordance with an object.

The sheet conveyance passages R includes an inlet opening side conveyance passage R1, a sub tray-directed conveyance passage R2, a stapling unit-directed conveyance passage R3, a main tray-directed conveyance passage R4, a stapling tray-directed conveyance passage R5, a detouring tray-directed conveyance passage R6 and a center-folding unit-directed conveyance passage R7. The inlet opening side conveyance passage R1 extends in a leftward direction from a sheet reception opening 13 of the sheet postprocessing apparatus 10 to a substantially central position in leftward and rightward directions of the sheet postprocessing apparatus 10. The sub tray-directed conveyance passage R2 diverges from a downstream end of the inlet opening side conveyance passage R1 and extends toward a sub tray 15. The stapling unit-directed conveyance passage R3 diverges from a downstream end of the inlet opening side conveyance passage R1 and extends toward a postprocessing space V1 of stapling unit 20. The main tray-directed conveyance passage R4 extends from an upper end of the postprocessing space V1 toward a main tray 14. The stapling tray-directed conveyance passage R5 diverges leftward from a downstream end of the stapling unit-directed conveyance passage R3 and extends toward a stapling tray 30. The detouring tray-directed conveyance passage R6 diverges from a downstream end of the stapling unit-directed conveyance passage R3 and extends rightward. The center-folding unit-directed conveyance passage R7 passes through a detouring tray 40 and extends toward a center-folding unit 17. Further, at a lower position of the staple tray 30, an end-binding stapler 38 for performing an end-binding processing to a stack P1 of recording sheets formed in the stapling tray 30.

At a downstream end of the inlet opening side conveyance passage R1, a switching guide 18 is provided for switching a conveyance passage of the recording sheet P to the sub tray-directed conveyance passage R2 and the stapling unit-directed conveyance passage R3. When the end-binding processing is not performed to the recording sheet P, the recording sheet P is discharged to the sub tray 15 through the sub tray directed conveyance passage R2 by a predetermined position setting of the switching guide 18. On the other hand, when the end-binding processing is performed to the recording sheet P, the recording sheet P is conveyed to the stapling unit 20 through the stapling unit-directed conveyance passage R3 in accordance with a change in a posture of the switching guide 18. Then, the end-binding stapler 38 performs the end-binding processing to the stack P1 of recording sheets in a state where a predetermined number of recording sheets P are stored in the postprocessing space V1 so that the stack P1 of recording sheets is formed. After the end-binding processing is performed, the stack P1 of recording sheets is discharged to the main tray 14 through the main tray-directed conveyance passage R4.

The center-folding unit-directed conveyance passage R7 extends downward from a substantially central position in upward and downward directions of the detouring tray 40. A recording sheet P subjected to the center-folding processing passes through an upper portion of a main body of the detouring tray and the center-folding unit-directed conveyance tray R7 and then led into the center-folding unit 17. A lower portion of the center-folding unit-directed conveyance passage R7 is formed so as to extend downward in a leftward direction from a lower end of the stapling unit 20 to the center-folding unit 17.

Figure 2:
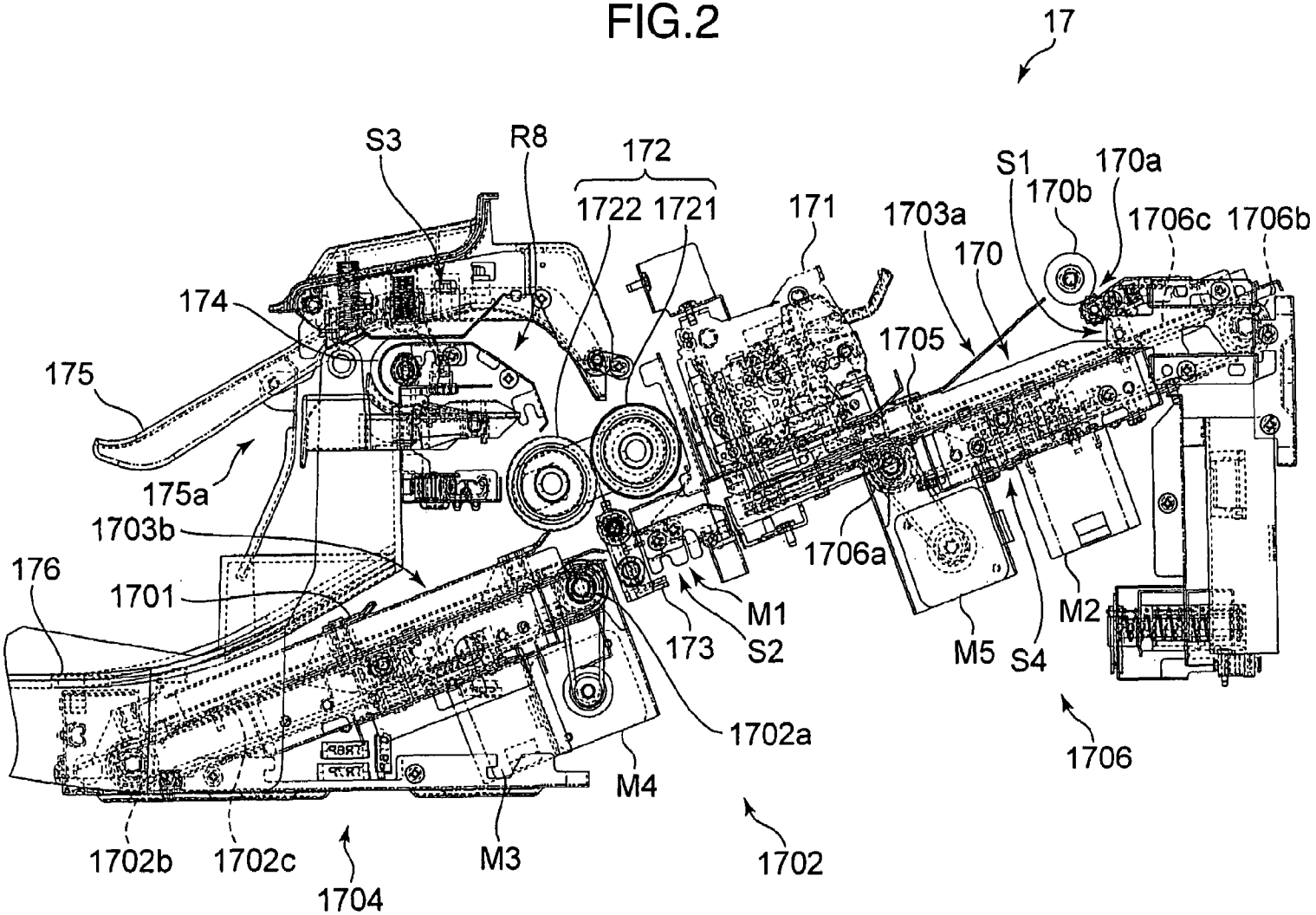
FIG. 2 is a front sectional view in which the center-folding unit is enlarged.
Figure 3:
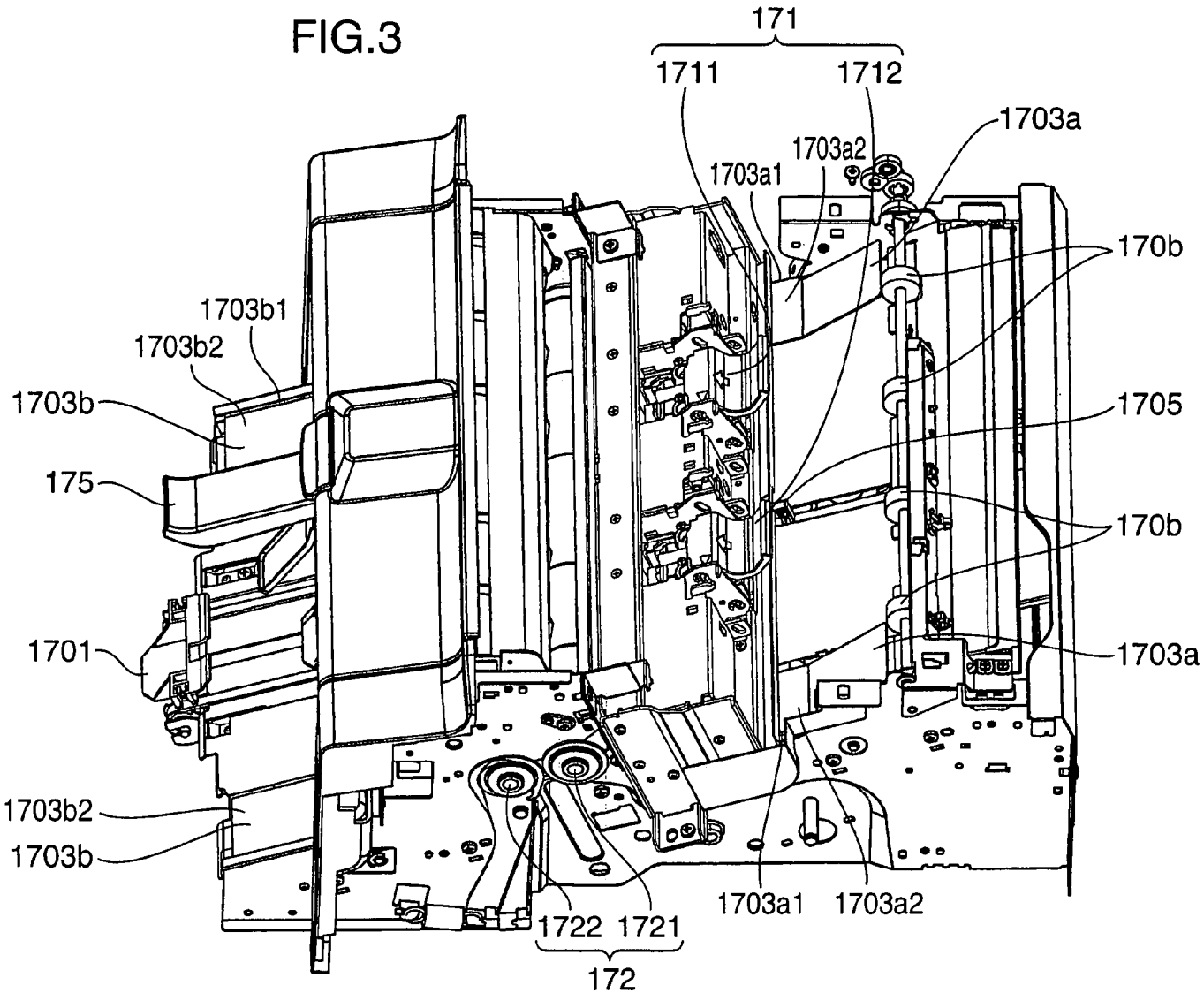
FIG. 3 is an exterior perspective view in which the center-folding unit is enlarged.

FIG. 2 is a front sectional view in which the center-folding unit 17 is enlarged. FIG. 3 is an exterior perspective view in which the center-folding unit 17 is enlarged. As shown in FIGS. 1, 2 and 3, the center-folding unit 17 as a sheet bending apparatus includes a sheet holding member 170, a center-binding stapler 171, a pair of bending rollers 172, a bending blade 173, a conveyance roller 174, and a pressing member 175. The sheet holding member 170 is connected to the center-folding unit-directed conveyance passage R7. The center-binding stapler 171 is provided in a central upper portion of the sheet holding member 170. The pair of bending rollers 172 are provided at an upper position of the sheet holding member 170 slightly on downstream from the center-binding stapler 171. The bending blade 173 is a plate-like member crossing the sheet holding member 170 and is provided in a lower portion of the sheet holding member 170 so as to face the pair of bending rollers 172. The conveyance roller 174 is provided on downstream (upper side) from the pair of bending rollers 172. The pressing member 175 is provided on downstream from the conveyance roller 174 and is pivotable around a predetermined axis.

The sheet holding member 170 is slanted such that a leading end thereof extends downward with respect to the inlet opening 170*a* with an angle of gradient of 30 degrees with respect to a horizontal surface. Accordingly, the recording sheet P is conveyed by the conveyance roller (conveying portion) 170*b* provided at the inlet opening 170*a* is smoothly conveyed along an upper surface of the sheet holding member 170. Further, in a vicinity of the inlet opening 170*a* for the conveyance of the recording sheet P, a conveyance sensor S1 for detecting the recording sheet P conveyed into the sheet holding member 170 is provided. The conveyance sensor S1 is turned on when it detects a leading end of the recording sheet P, and is turned OFF after it detects a tailing end of the recording sheet P.

The sheet holding member 170 includes a stack lifting cursor (restricting member) 1701, a stack lifting cursor moving portion 1702, a pair of upper side end aligning cursors (upper side end aligning members) 1703*a*, a pair of lower side end aligning cursors (lower side end aligning member) 1703*b* and a side end aligning cursor moving portion 1704. The stack lifting cursor 1701 is adapted for restricting a leading end of the recording sheet P placed in the sheet holding member 170. The sheet lifting cursor moving portion 1702 is adapted for making the stack lifting cursor 1701 move along the sheet holding member 170. The pair of upper side end aligning cursors 1703*a* and the pair of lower side end aligning cursors 1703*b* are respectively positioned at opposite side ends of the sheet holding member 170 on upstream and downstream in a sheet conveyance direction, and perform the side end aligning and obliqueness correction to a stack P2 of recording sheets including a plurality of recording sheets P placed in the sheet holding member 170. The side end aligning cursor moving portion 1704 is adapted for reciprocating the upper side end aligning cursors 1703*a* and the lower side end aligning cursors 1703*b* equally in opposite width directions of the sheet holding member 170 and independently from each other.

In a state where the side end aligning cursor moving portion 1704 performs side end aligning and the obliqueness correction to the stack P2 of recording sheets including a plurality of recording sheets P, the stack lifting cursor moving portion 1702 moves the stack lifting cursor 1701 so as to place the same at a position where the stack P2 of recording sheets can be subjected to the center-binding by the center-binding stapler 171. Thereafter, the stack lifting cursor moving portion 1702 moves the stack lifting cursor 1701 to a position where the stack P2 performed with the center-binding can be bent at its center by the pair of bending rollers 172 and the bending blade 173. Further, at a predetermined position in the bending blade 173 driven by a bending blade motor M1, a blade HP sensor S2 for detecting a home position (HP) of the bending blade 173 is positioned. The blade HP sensor S2 is turned on when the bending blade 173 comes to the home position thereof.

Figure 4:
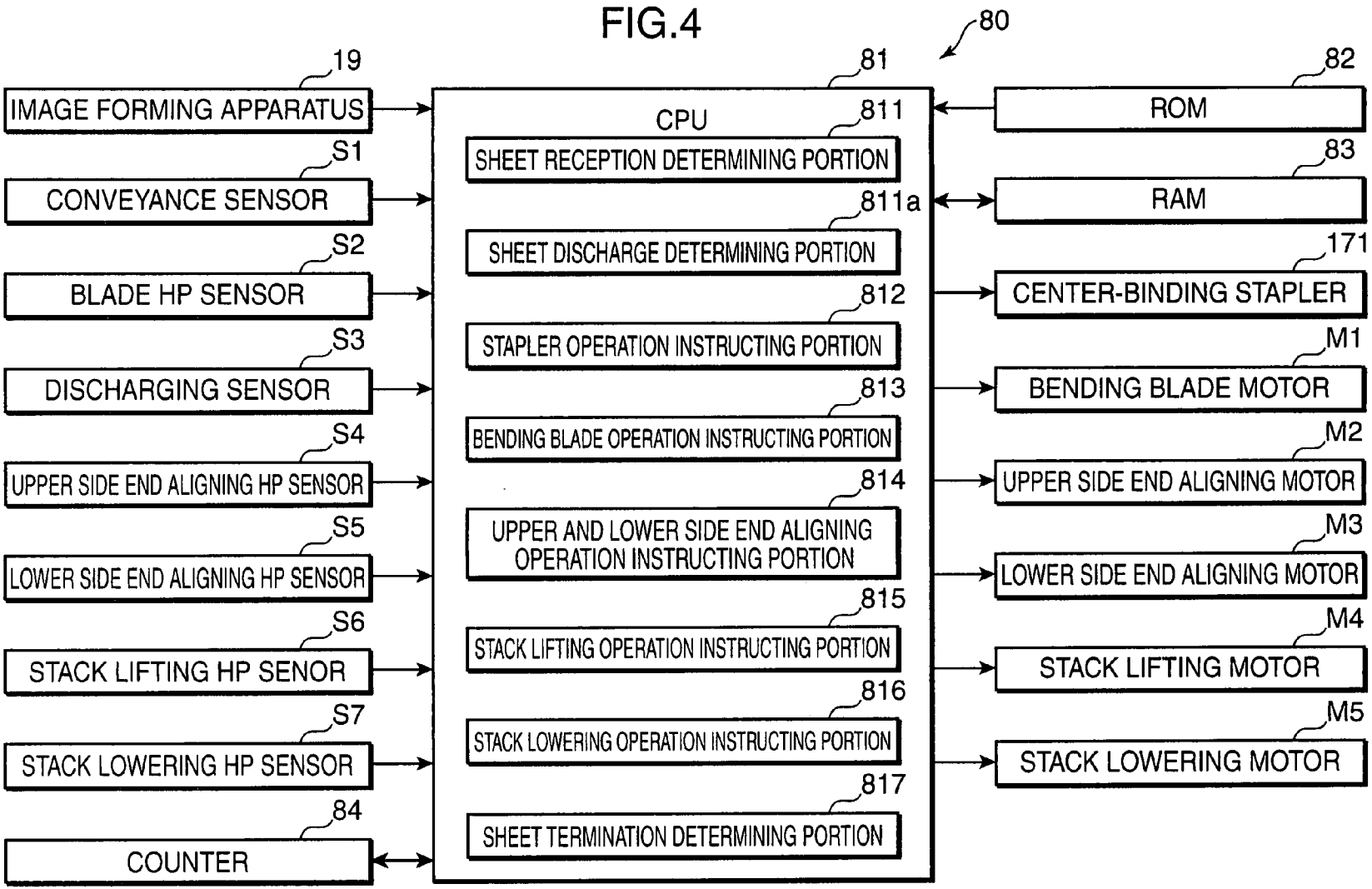
FIG. 4 is a functional block diagram of a controller.

Further, the sheet holding member 170 includes a stack lowering cursor (supporting member) 1705 and a stack lowering cursor moving portion 1706. The stack lowering cursor 1705 is adapted for aligning a tailing end of the stack P2 of recording sheets placed in the sheet holding member 170. The stack lowering cursor moving portion 1706 is adapted for making the stack lowering cursor 1705 move along the sheet holding member 170. The sheet holding member 170 is provided with an upper side end aligning HP sensor S4, a lower side end aligning HP sensor S5, a stack lifting HP sensor S6 and a stack lowering HP sensor S7 adapted for detecting home positions (HP) of the upper side end aligning cursors 1703*a*, the lower side end aligning cursors 1703*b*, the stack lifting cursor 1701 and the stack lowering cursor 1705 respectively are provided at predetermined portions thereof (FIG. 4). The upper side end aligning HP sensor S4, the lower side end aligning HP sensor S5, the stack lifting HP sensor S6 and the stack lowering HP sensor S7 are turned on when the upper side end aligning cursors 1703*a*, the lower side end aligning cursors 1703*b*, the stack lifting cursor 1701 and the stack lowering cursor 1705 move to the respective home positions.

At an upper end on downstream of the sheet holding member 170, a driving pulley 1702*a* driven by a stack lifting motor (restricting member driver) M4 is provided. At a lower end on downstream of the sheet holding member 170, a driven pulley 1702*b* driven in accordance with a rotation of the driving pulley 1702*a* is provided. An endless belt 1702*c* is placed between both pulleys 1702*a*, 1702*b* so that it is extend in a conveyance direction at a central portion in a width direction on downstream of the sheet holding member 170. At a predetermined position on an upper surface of the endless belt 1702*c*, the stack lifting cursor 1701 having a Γ-shaped side cross-section is integrally formed so that the stack lifting cursor 1701 moves on the sheet holding member 170 in accordance with a revolving of the endless belt 1702*c*. The stack lifting cursor moving portion 1702 is constructed by the stack lifting motor M4, the pulleys 1702*a*, 1702*b*, the endless belt 1702*c* and a stack lifting operation instructing portion 815 (FIG. 4) which is to be described hereinafter.

At a lower end on upstream of the sheet holding member 170, a driving pulley 1706*a* driven by a stack lowering motor (supporting member driver) M5 is provided. At an upper end on upstream of the sheet holding member 170, a driven pulley 1706*b* driven in accordance with a rotation of the driving pulley 1706*a* is provided. An endless belt 1706*c* is placed between both pulleys 1706*a*, 1706*b* so that it extends in a conveyance direction at a central portion in a width direction on upstream of the sheet holding member 170. At a predetermined position on an upper surface of the endless belt 1706*c*, the stack lowering cursor 1705 having a inverse Γ-shaped side cross-section is integrally formed so that the stack lowering cursor 1705 moves on the sheet holding member 170 in accordance with a revolving of the endless belt 1706*c*. The stack lowering cursor moving portion 1706 is constructed by the stack lowering motor M5, the pulleys 1706*a*, 1706*b*, the endless belt 1706*c* and a stack lowering operation instructing portion 816 (FIG. 4) which is to be described hereinafter. The stack lifting motor M4 and the stack lowering motor M5 drive stack lifting cursor 1701 and the stack lowering cursor 1705 in a state where the stack lifting cursor 1701 comes in contact with the leading end of the recording sheet and the stack lowering cursor 1705 comes in contact with the tailing end of the recording sheet.

Each of the upper side end aligning cursors 1703*a* includes a guiding wall portion having a front cross section of Γ-shape or inverse Γ-shape and standingly provided on one of the opposite side ends of the endless belt 1706*c*. A top wall portion provided on upper end of each guiding wall portion has an upstream end portion rising upward so that the recording sheet conveyed from the conveying roller 170*b* is easily conveyed in the guiding wall portion. More particularly, each of the pair of the upper side end aligning cursors 1703*a* includes: a side wall portion 1703*a*1 provided on one of the opposite side ends of the holding member 170 and extending along the sheet conveyance direction; and a top wall portion 1703*a*2 being substantially perpendicular to the side wall portion 1703*a*1 and extending inward from an end of the side wall portion 1703*a*1 toward the sheet holding member 170. The top wall portion 1703*a*2 has an upstream end portion rising upward.

The upper side end aligning cursors 1703*a* further include a pair of left and right racks (unillustrated) supported on the guiding wall portion and freely movable in width directions of the sheet holding member 170, a pinion (unillustrated) engaged with the racks and an upper side end aligning motor (upper side end aligning driver) M2 for driving these pinions. The upper side end aligning motor M2 drives the pair of upper side end aligning cursors 1703*a* so that the upper side end aligning cursors 1703*a* approach the recording sheet placed in the sheet holding member 170. The upper side end aligning motor M2 drive the upper side end aligning cursors 1703*a* in a state where the stack lifting cursor 1701 restricts the recording sheet placed in the sheet holding member 170.

Each of the lower side end aligning cursors 1703*b* includes a guiding wall portion having a front cross section of Γ-shape or inverse Γ-shape and standingly provided on one of the opposite side ends of the endless belt 1702*c*. Being different from the guiding wall portions of the upper side end aligning cursors 1703*a*, the guiding wall portions of the lower side end aligning cursors 1703*b* have an overall straight shape. More particularly, each of the pair of the lower side end aligning cursors 1703*b* includes: a side wall portion 1703*b*1 standingly provided on one of the opposite side ends of the holding member 170 and extending along the sheet conveyance direction; and a top wall portion 1703*b*2 being substantially perpendicular to the side wall portion 1703*b*1 and extending inward from an end of the side wall portion 1703*b*1 toward the sheet holding member 170.

The lower side end aligning cursors 1703*b* further include a pair of left and right racks (unillustrated) supported on the guiding wall portion and freely movable in width directions of the sheet holding member 170, a pinion (unillustrated) engaged with the racks and a lower side end aligning motor (lower side end aligning driver) M3 for driving these pinions. The lower side end aligning motor M3 drives the pair of lower side end aligning cursors 1703*b* so that the lower side end aligning cursors 1703*b* approach the recording sheet placed in the sheet holding member 170. The lower side end aligning motor M3 drive the lower side end aligning cursors 1703*b* in a state where the stack lifting cursor 1701 restricts the recording sheet placed in the sheet holding member 170.

The side end aligning cursor moving portion 1704 is constructed by the upper side end aligning motor M2, the lower side end aligning motor M3, the racks, the pinions and the upper and lower side end aligning operation instructing portion 814 (FIG. 4) which is to be described hereinafter. The side end aligning cursor moving portion 1704 is capable moving the upper side end aligning cursors 1703*a* and the lower side end aligning cursors 1703*b* independently.

Then, the side end aligning cursor moving portion 1704 makes the upper side end aligning cursors 1703*a* approach the recording sheet P in course of being conveyed into the sheet holding member 170 a predetermined distance shorter than a predetermined approaching distance. Then, the side end aligning cursor moving portion 1704 makes the upper side end aligning cursors 1703*a* approach the recording sheet P placed in the sheet holding member 170 a remainder of the approaching distance. Further, while the side end aligning cursor moving portion 1704 makes the upper side end aligning cursors 1703*a* approach the recording sheet P a remainder of the approaching distance, the side end aligning cursor moving portion 1704 makes the lower side end aligning cursors 1703*b* approach the recording sheet P placed in the sheet holding member 170 a predetermined approaching distance.

The center-binding stapler 171 is adapted for driving staples collectively to a central portion in the conveyance direction of the stack P2 of recording sheets formed by stacking a predetermined number of recording sheets P and aligned by the side end aligning by using a pair of staplers 1711, 1712. Namely, the center-binding stapler 171 performs a center-binding processing. Each of the staplers 1711, 1712 includes at respective lower end thereof a folding portion. At the time when a staple is pierced through the stack P2 of the recording sheets from a front surface and folded back at a back surface of the stack P2, the folding portion makes the folding easier.

The pair of bending rollers 172 include two center-folding rollers 1721, 1722 driven by an unillustrated motor in a state of being synchronized with each other. The center-folding roller 1722 is elastically urged by an unillustrated spring in a direction coming close to the other center-folding roller 1721 and pressingly come in contact with the center-folding roller 1721 with a predetermined force at a nipping portion.

The bending blade 173 presses a central portion of the stack P2 of recording sheets, which is subjected to the center-binding processing performed by the center-binding stapler 171, toward a portion between the pair of bending rollers 172 by driving of a bending blade motor M1. Thus, the stack P2 of recording sheets which is in a state of being pressed at its central portion by the bending blade 173 and folded at its center is pressingly shoved into the center-folding conveyance passage R8 by the pair of bending rollers 172 and then is discharged to the center-folding tray 176 through a discharging opening 175*a* including a conveyance roller 174 and a pressing member 175. In a vicinity of the discharging opening 175*a*, a discharging sensor S3 for detecting the stack P2 of recording sheets discharged from the sheet holding member 170 is positioned. The discharging sensor S3 is turned on when it detects the stack P2 of recording sheets discharged from the sheet holding member 170.

To perform a control over the center-folding processing of the center-folding unit 17, a controller 80 including a microcomputer is provided. FIG. 4 is a functional block diagram of the controller 80. As shown in FIG. 4, the controller 80 has a fundamental construction including a CPU 81, ROM 82 and RAM 83. The ROM 82 and RAM 83 are connected to the CPU 81. Further, the CPU 81 is electrically connected to a group of sensors S1 through S7, the center-binding stapler 171 and a group of motors, e.g. step motors, M1 through M5. A program for performing the control is stored in ROM 82. Each time when a power source of the sheet postprocessing apparatus is turned on, the program is read by the CPU81. The RAM 83 is used for reading out and storing a temporary data necessary for the control.

The CPU 81 reads out the program to establish a sheet reception determining portion 811, a sheet discharge determining portion 811*a*, a stapler operation instructing portion 812, a bending blade operation instructing portion 813, an upper and lower side end aligning operation instructing portion 814, a stack lifting operation instructing portion 815, a stack lowering operation instructing portion 816 and a sheet termination determining portion 817. A counter 84 for counting the number of recording sheets discharged to the conveyance passage R7 in one job operation is provided outside the CPU 81.

The sheet reception determining portion 811 transmits a predetermined signal to the stapler operation instructing portion 812, the bending blade operation instructing portion 813, the upper and lower side end aligning operation instructing portion 814, the stack lifting operation instructing portion 815 and the stack lowering operation instructing portion 816 at each time when the recording sheet P passes through the sheet conveyance opening 170*a*. Therefore, the sheet reception determining portion 811 receives a detection signal (ON, OFF) transmitted from the conveyance sensor S1. Taking into consideration a time period during when the recording sheet P is in course of being conveyed to the conveyance roller 170*a* in accordance with the transmitted signal, the sheet reception determining portion 811 determines a timing of a conveyance of the recording sheet P to the sheet holding member 170 through the conveyance roller 170*a*. Then, the sheet reception determining portion 811 transmits a signal indicating such matter to the stapler operation instructing portion 812, the bending blade operation instructing portion 813, the upper and lower side end aligning operation instructing portion 814, the stack lifting operation instructing portion 815 and the stack lowering operation instructing portion 816.

The sheet discharge determining portion 811*a* transmits a predetermined signal to the stapler operation instructing portion 812, the bending blade operation instructing portion 813, the upper and lower side end aligning operation instructing portion 814, the stack lifting operation instructing portion 815 and the stack lowering operation instructing portion 816 at each time when the recording sheet P passes through the sheet conveyance opening 175*a*. The sheet discharge determining portion 811*a* receives a detection signal (ON) transmitted from the discharging sensor S3. Taking into consideration a time period during when the recording sheet P is in course of being conveyed to the conveyance roller 174 in accordance with the transmitted signal, the sheet discharge determining portion 811*a* determines a timing of a conveyance of the recording sheet P to the center-folding tray 176 through the conveyance roller 174. Then, the sheet discharge determining portion 811*a* transmits a signal which indicating such matter to the stapler operation instructing portion 812, the bending blade operation instructing portion 813, the upper and lower side end aligning operation instructing portion 814, the stack lifting operation instructing portion 815 and the stack lowering operation instructing portion 816.

The stapler operation instructing portion 812 transmits a control signal to the center-binding stapler 171 to make to perform the center-binding operation to the recording sheets after receiving a signal based on a result of the determination made in the sheet reception determining portion 811 or in the sheet discharge determining portion 811*a*. Then, a signal based on the result of the determination made in the sheet reception determining portion 811 or in the sheet discharge determining portion 811*a* is transmitted to the stapler operation instructing portion 812. When the signal is received, the stapler operation instructing portion 812 transmits a control signal to the center-binding stapler 171 to perform the center-binding operation to the recording sheet.

The bending blade operation instructing portion 813 transmits a control signal to the bending blade motor M1 to make the bending blade 173 move in a predetermined direction after it receives a signal based on a result of the determination made in the sheet reception determining portion 811 or in the sheet discharge determining portion 811*a*. Then, a signal based on a result of the determination made in the sheet reception determining portion 811 or in the sheet discharge determining portion 811*a* is transmitted to the bending blade operation instructing portion 813. When the signal is received, the bending blade operation instructing portion 813 transmits a control signal to the bending blade motor M1 to make the bending blade 173 move in a predetermined direction.

The upper and lower side end aligning operation instructing portion 814 transmits a control signal to the upper side end aligning motor M2 and the lower side end aligning motor M3 to make the upper side end aligning cursors 1703*a* and the lower side end aligning cursors 1703*b* move in a predetermined direction after it receives a signal based on a result of the determination made in the sheet reception determining portion 811 or in the sheet discharge determining portion 811*a*. Then, a signal based on the result of the determination made in the sheet reception determining portion 811 or in the sheet discharge determining portion 811*a* is transmitted to the upper and lower side end aligning operation instructing portion 814. When the signal is received, the upper and lower side end aligning operation instructing portion 814 transmits a signal to the upper side end aligning motor M2 and the lower side end aligning motor M3 to make the upper side end aligning cursors 1703*a* and the lower side end aligning cursors 1703*b* move in a predetermined direction.

After receiving a signal based on a result of a determination made in the sheet reception determining portion 811 or in the sheet discharge determining portion 811*a*, the stack lifting operation instructing portion 815 transmits to the stack lifting motor M4 a control signal of making the stack lifting cursor 1701 move in a predetermined direction. Then, a signal based on the result of determination made in the sheet reception determining portion 811 or the sheet discharge determining portion 811*a* is transmitted to the stack lifting operation instructing portion 815. After receiving the signal, the stack lifting operation instructing portion 815 transmits to the stack lifting motor M4 a control signal of making the stack lifting cursor 1701 move in a predetermined direction.

After receiving a signal based on a result of a determination made in the sheet reception determining portion 811 or in the sheet discharge determining portion 811*a*, the stack lowering operation instructing portion 816 transmits to the stack lowering motor M5 a control signal of making the stack lowering cursor 1705 move in a predetermined direction. Then, a signal based on the result of the determination made in the sheet reception determining portion 811 or in the sheet discharge determining portion 811*a* is transmitted to the stack lowering operation instructing portion 816. After receiving the signal, the stack lowering operation instructing portion 816 transmits to the stack lowering motor M5 a control signal of making the stack lowering cursor 1705 move in a predetermined direction.

The counter 84 counts the number of recording sheets P each time when the sheet reception determining portion 811 determines a reception of the recording sheet P and, on the other hand, inputs to the CPU 81 the counted number of recording sheets to be discharged from the image forming apparatus 19 to the sheet postprocessing apparatus 10.

At the time when the number of recording sheets counted by the counter 84 is matched with information of the number of sheets conveyed from the image forming apparatus 19, the sheet termination determining portion 817 transmits a signal based on the result of the determination to the stapler operation instructing portion 812, the bending blade operation instructing portion 813, the upper and lower side end aligning operation instructing portion 814, the stack lifting operation instructing portion 815 and the stack lowering operation instructing portion 816. Then, the stapler operation instructing portion 812, the bending blade operation instructing portion 813, the upper and lower side end aligning operation instructing portion 814, the stack lifting operation instructing portion 815 and the stack lowering operation instructing portion 816, all of which received the signal transmission, transmits a signal of suspending the respective operations to the center-binding stapler 171, the bending blade motor Ml, the upper side end aligning motor M2, the lower side end aligning motor M3, the stack lifting cursor 1701 and the stack lowering cursor 1705. Accordingly, the respective operations of the center-binding stapler 171, the bending blade motor M1, the upper side end aligning motor M2, the lower side end aligning motor M3, the stack lifting cursor 1701 and the stack lowering cursor 1705 are suspended.

Figure 5:
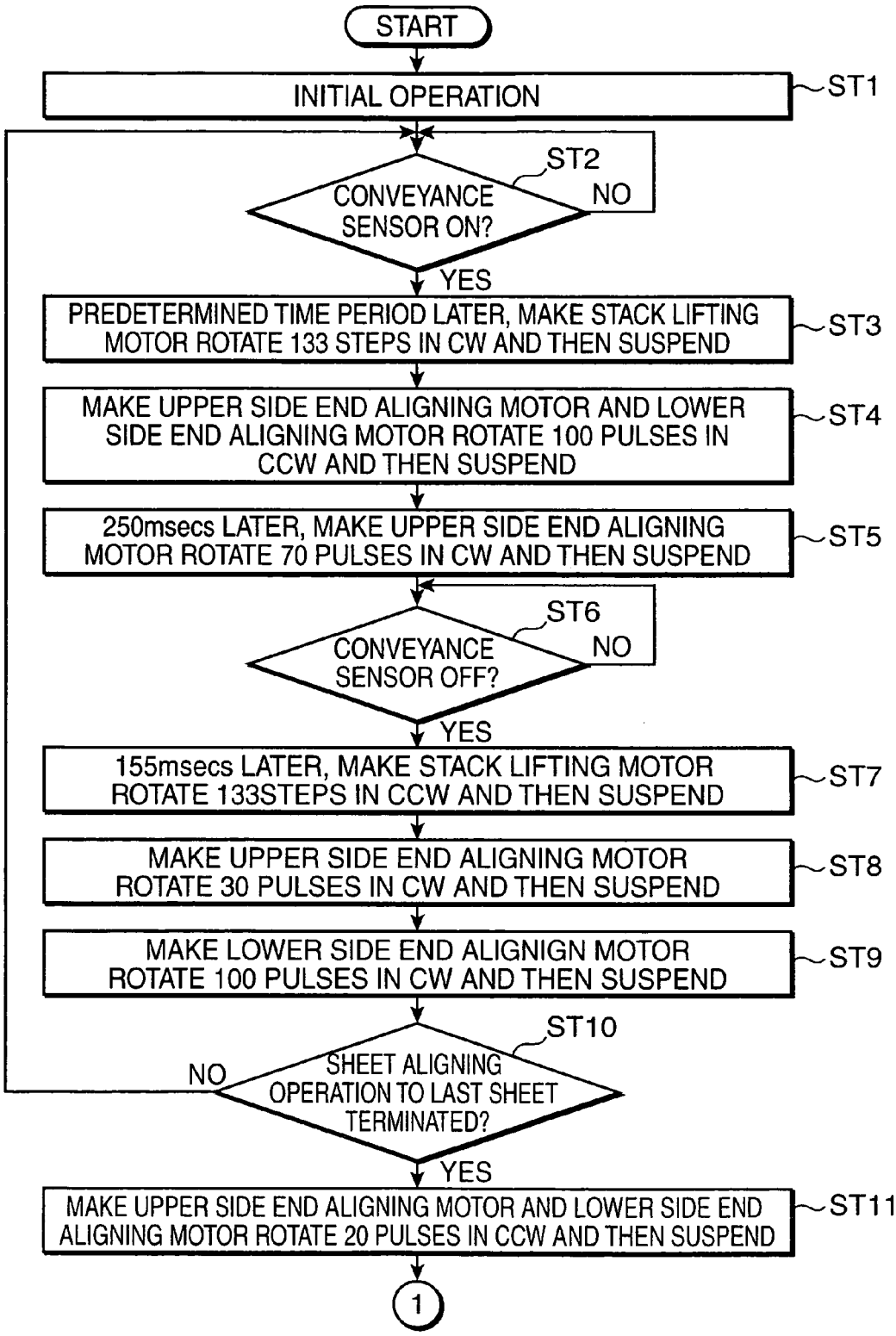
FIG. 5 is a flow chart showing an operation (former part) of the center-folding unit.
Figure 6:
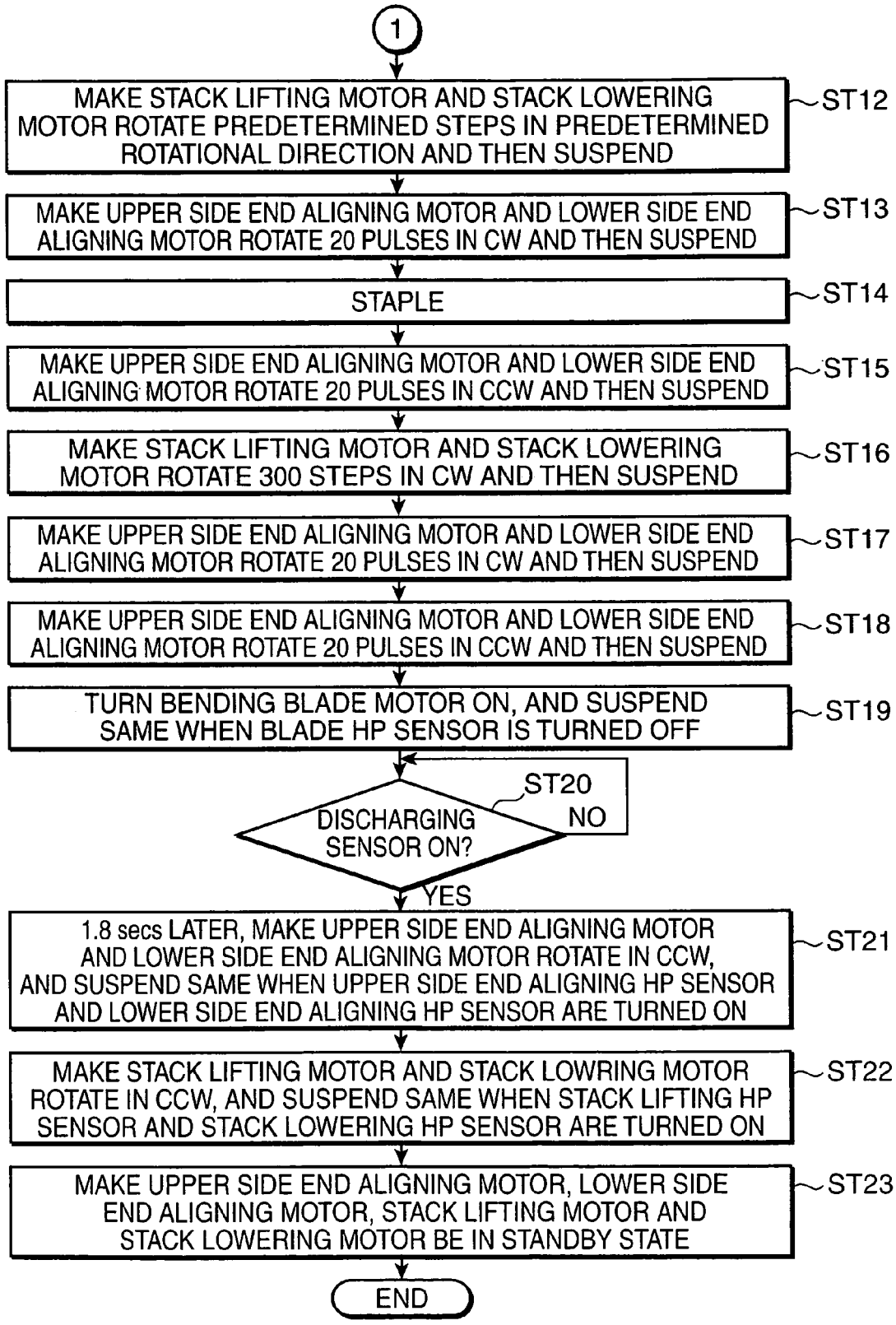
FIG. 6 is a flow chart showing an operation (latter part) of the center-folding unit.
Figure 7:
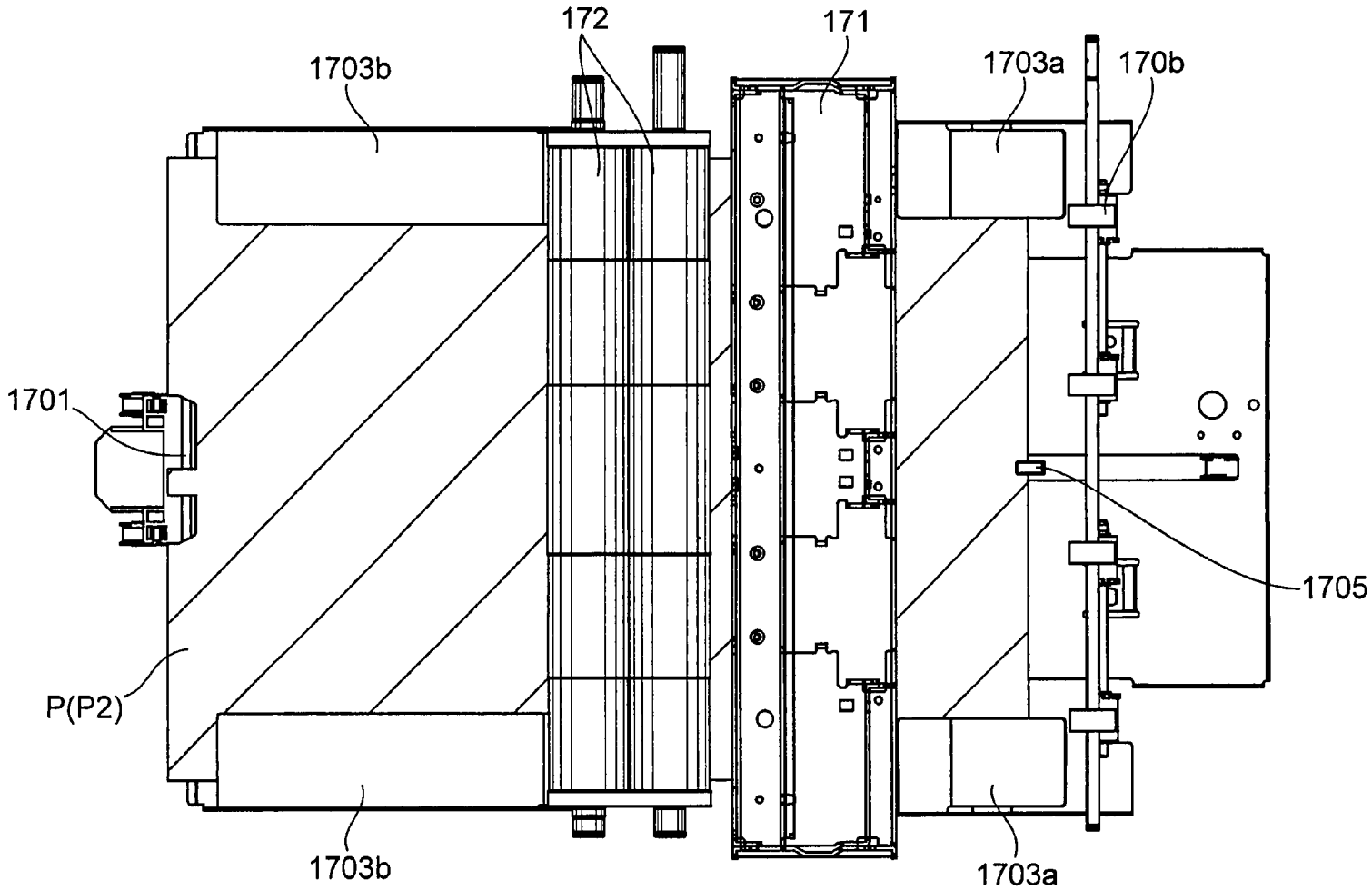
FIG. 7 is a plan view showing an example of a first operation of the center-folding unit.
Figure 8:
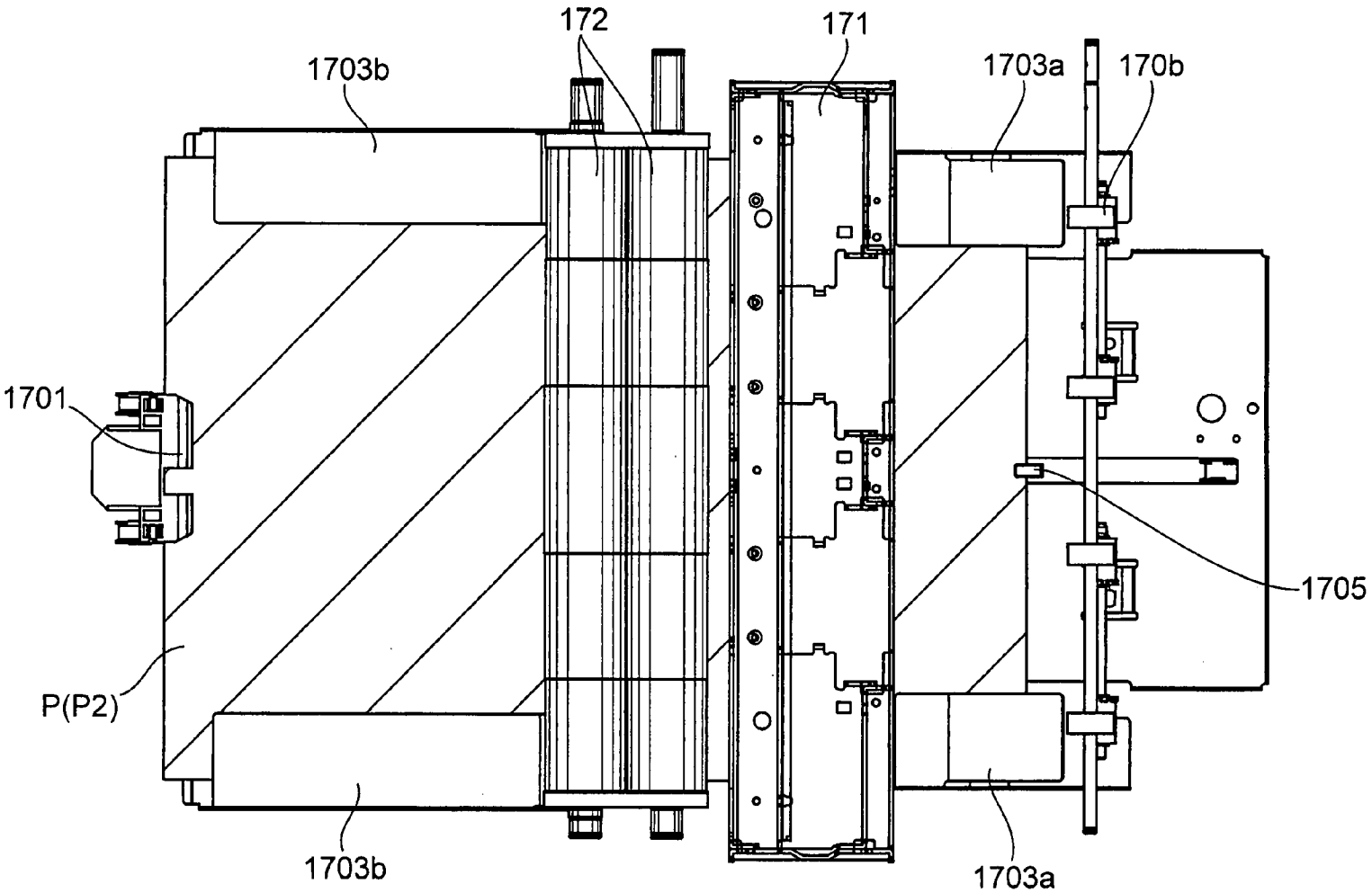
FIG. 8 is a plan view showing an example of a second operation of the center-folding unit.
Figure 9:
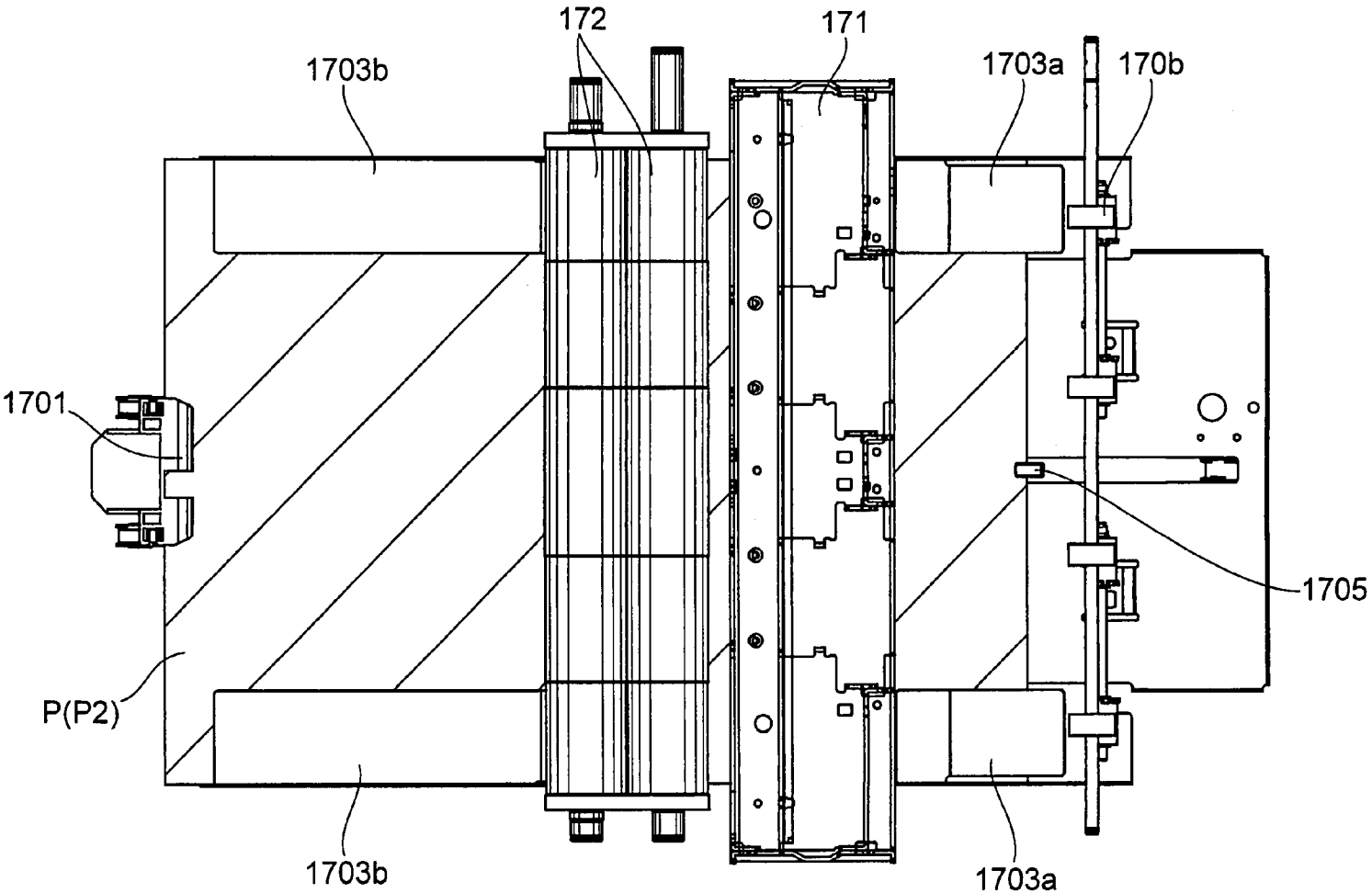
FIG. 9 is a plan view showing an example of a third operation of the center-folding unit.

Continuously, the center-folding operation performed by the center-folding unit 17 of the sheet postprocessing apparatus 10 is described. FIGS. 5 and 6 show a flowchart of an operation of the center-folding unit 17. FIGS. 7 through 9 are plan views showing respectively the first through third operations of the center-folding unit 17.

In FIG. 5, when a power is turned on, the upper and lower side end aligning operation instructing portion 814, the stack lifting operation instructing portion 815 and the stack lowering operation instructing portion 816 perform a predetermined initial operation. (Step ST1) In the initial operation, each of the members is set each of the home positions. Namely, the upper and lower side end aligning operation instructing portion 814 in the controller 80 in FIG. 4 transmits to the upper side end aligning motor M2 and the lower side end aligning motor M3 an instruction to rotate a predetermined step in a predetermined direction. In accordance with the instruction, the upper side end aligning motor M2 and the lower side end aligning motor M3 rotate predetermined steps in a predetermined direction. Then, when the upper side end aligning HP sensor S4 and the lower side end aligning HP sensor S5 are turned on, the upper and lower side end aligning operation instructing portion 814 makes the upper side end aligning motor M2 and the lower side end aligning motor M3 suspend. Further, the stack lifting operation instructing portion 815 transmits to the stack lifting motor M4 an instruction to rotate predetermined steps in a predetermined direction. In accordance with the instruction, the stack lifting motor M4 rotates predetermined steps in a predetermined direction. Then, when the stack lifting HP sensor S6 is turned on, the stack lifting operation instructing portion 815 makes the stack lifting motor M4 suspend. Further, the stack lowering operation instructing portion 816 transmits to the stack lowering motor M5 an instruction to rotate predetermined steps in a predetermined direction. In accordance with the instruction, the stack lowering motor M5 rotates predetermined steps in a predetermined direction. Then, when the stack lowering HP sensor S7 is turned on, the stack lowering operation instructing portion 816 makes the stack lowering motor M5 suspend.

Next, the sheet reception determining portion 811 determines whether or not the conveyance sensor S1 is turned on. Herein, the sheet reception determining portion 811 waits until it determines that the conveyance sensor S1 is turned on. (Step ST2) Then, after a predetermined time period passed since the sheet reception determining portion 811 determines that the conveyance sensor S1 is turned on, the stack lifting operation instructing portion 815 transmits to the stack lifting motor M4 an instruction to rotate 133 steps in a clockwise (CW) direction and then suspend. In accordance with the instruction from the stack lifting operation instructing portion 815, the stack lifting motor M4 rotates only 133 steps in a clockwise direction (CW) and then suspends. (Step ST3) Accordingly, the stacklifting cursor 1701 moves 26.6 mm downward from the home position on the sheet holding member 170.

Further, immediately after the sheet reception determining portion 811 determines that the conveyance sensor S1 is turned on, the upper and lower side end aligning operation instructing portion 814 transmits to the upper side end aligning motor M2 an instruction to rotate only 100 pulses in a counterclockwise direction (CCW) and then suspend, and also transmits to the lower side end aligning motor M3 an instruction to rotate only 100 pulses in a counterclockwise direction and then suspend. In accordance with the instruction from the upper and lower side end aligning operation instructing portion 814, the upper side end aligning motor M2 rotates only 100 pulses in a counterclockwise direction (CCW) and then suspends, and the lower side end aligning motor M3 also rotates only 100 pulses in a counterclockwise direction and then suspends.(Step ST4) Accordingly, the upper side end aligning cursors 1703*a* and the lower side end aligning cursors 1703*b* move 10 mm equally toward opposite side ends in width directions on the sheet holding member 170. (refer to FIG. 7) However, being different from the FIG. 7, at this time, the stack lowering cursor 1705 still remains at the home position and the recording sheet is about to be conveyed into the sheet holding member 170 by the conveyance roller 170*b* so that the stack lowering cursor 1705 does not interfere with a conveyance of the recording sheet.

250 msecs after this side end aligning operation is performed, the upper and lower side end aligning operation instructing portion 814 transmits to the upper side end aligning motor M2 an instruction to rotate 70 pulses in a clockwise direction and suspend. In accordance with the instruction from the upper and lower side end aligning operation instructing portion 814, the upper side end aligning motor M2 rotates only 70 pulses in a clockwise direction and then suspends. (Step ST5) Accordingly, the upper side end aligning cursors 1703*a* on both side ends move 7 mm toward a central position in the width direction. (refer to FIG. 8) At this time, side end of a leading end of the recording sheet is aligned, and the obliqueness correction is performed.

Next, the sheet reception determining portion 811 determines whether or not the conveyance sensor S1 is turned off. The sheet reception determining portion 811 waits until it determines that the conveyance sensor S1 is turned off. (Step ST6)

Then, after 155 msecs passed since the sheet reception determining portion 811 determines that the conveyance sensor S1 is turned off, namely, when one recording sheet P is completely placed in the sheet holding member 170, the stack lifting operation instructing portion 815 transmits to the stack lifting motor M4 an instruction to rotate only 133 steps in a counterclockwise direction and suspend. In accordance with the stack lifting operation instructing portion 815, the stack lifting motor M4 rotates 133 steps in a counterclockwise direction and then suspends. (Step ST7) Accordingly, the stack lifting cursor 1701 moves only 26.6 mm upward on the sheet holding member 170. In accordance with this movement, the recording sheet P moves upward so that a leading end of the next recording sheet does not interfere with a tailing end of the current recording sheet conveyed immediately before the next recording sheet.

After the stack lifting operation is performed, the upper and lower side end aligning operation instructing portion 814 transmits to the upper side end aligning motor M2 an instruction to rotate only 30 pulses in a clockwise direction and suspend. In accordance with the upper and lower side end aligning operation instructing portion 814, the upper side end aligning motor M2 rotates only 30 pulses in a clockwise direction and suspends. (Step ST8) Further, the upper and lower side end aligning operation instructing portion 814 transmits to the lower side end aligning motor M3 an instruction to rotate only 100 pulses in a clockwise direction and suspend. In accordance with the upper and lower side end aligning operation instructing portion 814, the lower side end aligning motor M3 rotates only 100 pulses in a clockwise direction and then suspends. (Step ST9) Accordingly, the upper side end aligning cursors 1703*a* move 3 mm on both sides toward a central portion in a width direction, and the lower side end aligning cursors 1703*b* move 10 mm on both sides toward a central portion in a width direction. (refer to FIG. 9) At this time, the recording sheets P are aligned and corrected with obliqueness by both of the upper side end aligning cursors 1703*a* and the lower side end aligning cursors 1703*b*.

Next, the sheet termination determining portion 817 determines whether or not the sheet aligning operation with respect to the last recording sheet, i.e. the side end aligning and the obliqueness correction, is terminated. (Step ST10) Herein, if the sheet termination determining portion 817 determines that the sheet aligning operation is not terminated, the process goes back to the Step ST2, and the processings of Steps ST2 through ST9 are repeated. This repetition of the processings makes a predetermined numbers of recording sheets P be a stack. Thereafter, the center-binding processing and the like are performed to the recording sheets in a unit of the stack P2. In a case where the second recording or later recording sheet is conveyed to the sheet holding member 170, the processing in the Step ST3 is omitted, but the processing in the Step ST4 is performed after the processing in the Step ST2.

Then, when the sheet termination determining portion 817 determines that the sheet aligning operation with respect to the last recording sheet is terminated, the process proceeds to Step ST11. Herein, at first, the upper and lower side end aligning operation instructing portion 814 transmits to the upper side end aligning motor M2 and to the lower side end aligning motor M3 an instruction to rotate 20 pulses in a counterclockwise direction respectively and suspend. In accordance with the instruction from the upper and lower side end aligning operation instructing portion 814, the upper side end aligning motor M2 and the lower side end aligning motor M3 move 20 pulses in a counterclockwise direction respectively and suspend. (Step ST11) Accordingly, both the upper side end aligning cursors 1703*a* and the lower side end aligning cursors 1703*b* move 2 mm toward opposite end sides in a width direction. Accordingly, the recording sheet placed between the upper side end aligning cursors 1703*a* and the lower side end aligning cursors 1703*b* is allowed to move.

Next, in FIG. 6, the stack lifting operation instructing portion 815 transmits to the stack lifting motor M4 an instruction to rotate a predetermined step in a predetermined rotational direction and suspend. Further, the stack lowering operation instructing portion 816 transmits to the stack lowering motor M5 an instruction to rotate predetermined step in a predetermined rotational direction and suspend. In accordance with the instructions transmitted from the stack lifting operation instructing portion 815 and the stack lowering operation instructing portion 816, the stack lifting motor M4 and the stack lowering motor M5 rotate predetermined steps in a predetermined rotational direction and then suspend, respectively. (Step ST12) Accordingly, the recording sheets can be easily positioned at a predetermined position at which the center-binding processing is performed.

Further, the upper and lower side end aligning operation instructing portion 814 transmits to the upper side end aligning motor M2 and the lower side end aligning motor M3 an instruction to rotate 20 pulses in a clockwise direction and suspend respectively. In accordance with the instruction from the upper and lower side end aligning operation instructing portion 814, the upper side end aligning motor M2 and the lower side end aligning motor M3 rotate 20 pulses in a clockwise direction and then suspend. (Step ST13) Accordingly, the upper side end aligning cursors 1703*a* and the lower side end aligning cursors 1703*b* respectively move 2 mm toward a central portion in a width direction so that the upper side end aligning cursors 1703*a* and the lower side end aligning cursors fixedly holds the recording sheet. Next, the stapler operation instructing portion 812 transmits to the center-binding stapler 171 an instruction to perform a predetermined center-binding processing. In accordance with the stapler operation instructing portion 812, the center-binding stapler 171 performs a predetermined center-binding processing. (Step ST14)

Continuously, the upper and lower side end aligning operation instructing portion 814 transmits to the upper side end aligning motor M2 and the lower side end aligning motor M3 an instruction to rotate 20 pulses in a counterclockwise direction and suspend. In accordance with the instruction from the upper and lower side end aligning operation instructing portion 814, the upper side end aligning motor M2 and the lower side end aligning motor M3 rotate 20 pulses in a counterclockwise direction and then suspend respectively. (Step ST15) Accordingly, the upper side end aligning cursors 1703*a* and the lower side end aligning cursors 1703*b* move 2 mm in opposite direction toward both end sides in width directions. Accordingly, the recording sheet placed between the upper side end aligning cursors 1703*a* and the lower side end aligning cursors 1703*b* is allowed to move.

Further, the stack lifting operation instructing-portion 815 transmits to the stack lifting motor M4 an instruction to rotate 300 steps in a clockwise direction and suspend, and the stack lowering operation instructing portion 816 transmits to the stack lowering motor M5 an instruction to rotate 300 steps in a clockwise direction and suspend. The stack lifting motor M4 rotates 300 steps in a clockwise direction and then suspends the rotation in accordance with the instruction from the stack lifting operation instructing portion 815, and the stack lowering motor M5 rotates 300 steps in a clockwise direction and then suspends the rotation in accordance with the instruction from the stack lowering operation instructing portion 816. (Step ST16) Accordingly, the stack lowering cursor 1705 moves only 30 mm downward on the sheet holding member 170, and the stack lifting cursor 1701 moves 30 mm downward on the sheet holding member 170. Accordingly, the stack P2 of recording sheets nipped between both cursors 1701, 1705 is easily placed at a position where the center-folding process can be performed by the pair of bending rollers 172 and the bending blade 173.

Next, the upper and lower side end aligning operation instructing portion 814 transmits to the upper side end aligning motor M2 and the lower side end aligning motor M3 an instruction to rotate 20 pulses in a clockwise direction and suspend. In accordance with the instruction from the upper and lower side end aligning operation instructing portion 814, the upper side end aligning motor M2 and the lower side end aligning motor M3 rotate 20 pulses in a clockwise direction and then suspend. (Step ST17) Accordingly, the upper side end aligning cursors 1703*a* and the lower side end aligning cursors 1703*b* move 2 mm toward a center portion in a width direction. Accordingly, the side end aligning and the obliqueness correction are performed to the stack P2 of the recording sheets.

Further, the upper and lower side end aligning operation instructing portion 814 transmits to the upper side end aligning motor M2 and the lower side end aligning motor M3 an instruction to rotate 20 pulses in a counterclockwise direction and suspend. In accordance with the instruction from the upper and lower side end aligning operation instructing portion 814, the upper side end aligning motor M2 and the lower side end aligning motor M3 rotate 20 pulses in a counterclockwise direction and then suspend respectively. (Step ST18) Accordingly, the upper side end aligning cursors 1703*a* and the lower side end aligning cursors 1703*b* move 2 mm toward side ends in a width direction. Accordingly, the stack P2 of recording sheets is allowed to move so that the center-folding processing can be performed thereto.

Next, the bending blade operation instructing portion 813 transmits a to the bending blade motor M1 a driving instruction. In accordance with the instruction from the bending blade operation instructing portion 813, the bending blade motor M1 is turned on and drives. (Step ST19) Accordingly, the bending blade 173 pushes up the central portion of the stack P2 of recording sheets toward a nip portion of the pair of bending rollers 172 so that the stack P2 of recording sheets nipped by the pair of bending rollers 172 is bent in two-fold. Then, the stack P2 of recording sheets pass through a portion between the pair of bending rollers 172 and is discharged. At the time when the bending blade 173 moves back to the home position and the blade HP sensor S2 is turned off, the bending blade motor M1 suspends.

Next, the sheet discharge determining portion 811*a* determines whether or not the discharging sensor S3 is turned on. The sheet discharge determining portion 811*a* waits until it determines that the discharging sensor S3 is turned on. (Step ST20) Then, 1.8 secs after the sheet discharge determining portion 811*a* determines that the discharging sensor S3 is turned on, the upper and lower side end aligning operation instructing portion 814 transmits to the upper side end aligning motor M2 and the lower side end aligning motor M3 an instruction to move in a counterclockwise direction. In accordance with the instruction from the upper and lower side end aligning operation instructing portion 814, the upper side end aligning motor M2 and the lower side end aligning motor M3 move respectively in a counterclockwise direction, and then stop at the time when the upper side end aligning HP sensor S4 and the lower side end aligning HP sensor S5 are turned on. (Step ST21)

Further, the stack lifting operation instructing portion 815 transmits to the stack lifting motor M4 an instruction to rotate in a counterclockwise direction. In accordance with the instruction from the stack lifting operation instructing portion 815, the stack lifting motor M4 rotates in a counterclockwise direction, and then suspends the motor at the time when the stack lifting HP sensor S6 is turned on. Further, the stack lowering operation instructing portion 816 transmits to the stack lowering motor M5 an instruction to rotate in a counterclockwise direction. In accordance with the instruction from the stack lowering operation instructing portion 816, the stack lowering motor M5 rotates in a counterclockwise direction, and then suspends the motor at the time when the stack lowering HP sensor S7 is turned on. (Step ST22)

Accordingly, the upper side end aligning motor M2, the lower side end aligning motor M3, the stack lifting motor M4 and the stack lowering motor M5 turn into a standby operation, and then the job is terminated. (Step ST23)

As described above in detail, the sheet postprocessing apparatus 10 according to the embodiment includes the pair of upper side end aligning cursors 1703*a* positioned on upstream in the sheet conveyance direction on the sheet holding member 170 and being movable equally in opposite width directions of the sheet holding member 170; and the pair of lower side end aligning cursors 1703*b* positioned on downstream in the sheet conveyance direction on the sheet holding member 170 and being movable equally in opposite width directions of the sheet holding member 170 and independently from the upper side end aligning cursors 1703*a*. Accordingly, the operation of both members taking in consideration the difference between a timing at which the upper side end aligning cursors 1703*a* come in contact with the recording sheet P and a timing at which the lower side end aligning cursors 1703*b* come in contact with the recording sheet P can be performed so that the side end aligning and the obliqueness correction can be assuredly performed with respect to the recording sheet P on upstream and downstream in the sheet conveyance direction on the sheet holding member 170. Consequently, the alignment of the stack P2 of recording sheets at the time of the center-folding processing can be enhanced.

Further, in the above-described embodiment, the center-binding stapler 171 is mounted in the center-folding unit 17. However, it is not necessarily relevant to mount this center-binding stapler 171 in the center-folding unit 17. In such a case, for example, the center-binding stapler 171 may be mounted in the stapling tray 30 on upstream of the sheet postprocessing apparatus 10 for use.

Further, in the above-described embodiment, the center-folding unit 17 provided in the sheet postprocessing apparatus 10 connected to the image forming apparatus 19 is described. However, the present invention can be applied in a similar fashion to other center-folding apparatus.

Further, the specific embodiment described above includes an invention includes the following construction.

When side end aligning members perform a side end aligning and an obliqueness correction to a recording sheet, it is preferable to use both side end aligning members on downstream to which the recording sheet comes in contact after the recording sheet is placed in the sheet holding member and side end aligning members on upstream to which the recording sheet comes in contact in course of being conveyed into the sheet holding member. In such a case, since the timing at which the side end aligning members on upstream come in contact with the recording sheet and the timing at which the side end aligning member on downstream come in contact with the recording sheet differ, it is necessary to provide members taking in consideration of the difference in the timings.

Therefore, a sheet bending apparatus according to one aspect of the present invention includes a sheet bending apparatus for performing a center-folding processing to a stack of a plurality of recording sheets which are placed in a sheet holding member and whose both side ends are aligned, the center-folding processing being performed in a vicinity of a central portion in a sheet conveyance direction of the sheet holding member, the sheet bending apparatus comprising: a pair of upper side end aligning members positioned on upstream in the sheet conveyance direction on the sheet holding member and being movable equally in opposite width directions of the sheet holding member; a pair of lower side end aligning members positioned on downstream in the sheet conveyance direction on the sheet holding member and being movable equally in opposite width directions of the sheet holding member and independently from the upper side end aligning members.

According to this construction, a pair of upper side end aligning members are positioned on upstream in the sheet conveyance direction on the sheet holding member and are movable equally in opposite width directions of the sheet holding member, and a pair of lower side end aligning members are positioned on downstream in the sheet conveyance direction on the sheet holding member and are movable equally in opposite width directions of the sheet holding member and independently from the upper side end aligning members.

Thus, an operation taking in consideration of a difference between the timing at which the upper side end aligning members come in contact with the recording sheet and the timing at which the lower side end aligning members come in contact with the recording sheet can be performed, and the side end aligning and the obliqueness correction to the recording sheet can be assuredly performed on both upstream and downstream in the sheet conveyance direction on the sheet holding member. Accordingly, the alignment of the recording sheets at the time of the center-folding processing can be enhanced.

In the sheet bending apparatus, it is preferable that each of the pair of the upper side end aligning member includes: a side wall portion standingly provided on one of the opposite side ends of the sheet holding member, the side wall portion extending along the sheet conveyance direction; and a top wall portion extending inward substantially perpendicularly from an end of the side wall portion toward the sheet holding member, the top wall portion having an upstream end portion rising upward.

According to the construction, each of the pair of the upper side end aligning member includes a side wall portion standingly provided on one of the opposite side ends of the sheet holding member and extending along the sheet conveyance direction, and a top wall portion extending inward substantially perpendicularly from an end of the side wall portion toward the sheet holding member and having an upstream end portion rising upward. Accordingly, the recording sheet to be conveyed is easily placed between the upper side end aligning members so that the recording sheet can be assuredly placed in the sheet holding member.

It is preferable that the sheet bending apparatus further includes a restricting member movable along a sheet conveyance path of the sheet holding member and that the upper side end aligning members and the lower side end aligning members align the side ends of the recording sheet placed in the sheet holding member in a state where the recording sheet is restricted by the restricting member.

According to the construction, the restricting member is movable along a sheet conveyance path of the sheet holding member and capable of performing the side end aligning using the upper side end aligning members and the lower side end aligning members in a state where the restricting member restricts a leading end of the recording sheet placed in the sheet holding member.

Thus, the sheet side end aligning and the obliqueness correction to the recording sheet can be performed assuredly and stably both on upstream and downstream in the sheet conveyance direction on the sheet holding member. Accordingly, the alignment of the recording sheet at the time of center-folding processing can be enhanced.

It is preferable that the sheet bending apparatus further includes an upper side end aligning driver for driving the pair of upper side end aligning members so that the upper side end aligning members approach the recording sheet placed in the sheet holding member and a lower side end aligning driver for driving the pair of lower side end aligning members so that the upper side end aligning members approach the recording sheet placed in the sheet holding member, and that the upper side end aligning driver and the lower side end aligning driver drive the upper side end aligning members and the lower side end aligning members in a state where the restricting member restricts the recording sheet placed in the sheet holding member.

According to the construction, the upper side end aligning members and the lower side end aligning members are driven by the upper side end aligning driver and the lower side end aligning driver in a state where the recording sheet placed in the holding member is restricted by the restricting member. Accordingly, the upper side end aligning members performing the side end aligning on upstream of the recording sheet and the lower side end aligning members performing the side end aligning on downstream of the recording sheet can be driven independently from each other.

It is preferable that the sheet bending apparatus further includes a supporting member which supports a tailing end of the recording sheet placed in the sheet holding member and is movable along the sheet conveyance path on the sheet holding member and that the restricting member and the supporting member are movable in a state where the restricting member comes in contact with a leading end of the recording sheet and the supporting member comes in contact with the tailing end of the recording sheet.

According to the construction, the restricting member and the supporting member are movable in the restricting member comes in contact with a leading end of the recording sheet and the supporting member comes in contact with the tailing end of the recording sheet. Thus, even in the case where a frictional force generated between the recording sheet and the sheet holding member is great, the stack of recording sheets can be moved assuredly while resisting the frictional resistance.

It is preferable that the sheet bending apparatus further includes a restricting member driver for driving the restricting member and a supporting member driver for driving the supporting member, and that the restricting member driver and the supporting member driver drive the restricting member and the supporting member in a state where the restricting member comes in contact with the leading end of the recording sheet and the supporting member comes in contact with the tailing end of the recording sheet.

According to the construction, the restricting member and the supporting member are driven respectively by the restricting member driver and the supporting member driver in a state where the restricting member comes in contact with a leading end of the recording sheet and the supporting member comes in contact with a tailing end of the recording sheet. Thus, even in a case where a frictional resistance between the recording sheet and the sheet holding member is great, the stack of recording sheets can be moved assuredly while resisting the frictional resistance. Further, since the restricting member comes in contact with a leading end of the recording sheet and the supporting member comes in contact with the tailing end of the recording sheet, an alignment of the recording sheet in a sheet conveyance direction can be enhanced.

It is preferable that the sheet bending apparatus further includes a pair of bending rollers and a bending blade facing each other and positioned in a vicinity of a central portion in the sheet conveyance direction of the sheet holding member, and that the upper side end aligning members are provided on upstream from the pair of bending rollers and the bending blade, and the lower side end aligning members are provided on downstream from the pair of bending rollers and the bending blade.

According to the construction, a pair of bending rollers and a bending blade for performing the center-folding processing are facing each other and positioned in a vicinity of a central portion in the sheet conveyance direction of the sheet holding member, and the upper side end aligning members are provided on upstream from the pair of bending rollers and the bending blade, and the lower side end aligning members are provided on downstream from the pair of bending rollers and the bending blade. Thus, an alignment of the recording sheet at a position of the center-folding processing can be further enhanced.

It is preferable that the sheet bending apparatus further includes a center-binding stapler provided between the upper side end aligning members and the pair of bending rollers and the bending blade for performing a center-binding processing to the recording sheet placed in the sheet holding member.

According to the construction, the center-binding stapler for performing a center-binding processing to the recording sheet placed in the sheet holding member is provided between the upper side end aligning members and the pair of bending rollers and the bending blade. Thus, an alignment of the recording sheet at a position of the center-folding processing can be further enhanced.

A sheet postprocessing apparatus according to other aspect of the present invention includes: a main body connected to an image forming apparatus; the sheet bending apparatus of claim 1 provided in the main body; and a conveying portion for conveying a recording sheet formed with an image by the image forming apparatus to the sheet holding member.

According to the construction, any one of the sheet bending apparatus is provided in the main body of the sheet postprocessing apparatus connected to the image forming apparatus, and the recording sheet formed with an image by the image forming apparatus is conveyed to the sheet holding member so that the sheet side end aligning and the obliqueness correction is assuredly performed both on upstream and downstream in the sheet conveyance direction on the sheet holding member. Accordingly, the alignment of the recording sheet at the time of the center-folding processing can be enhanced.

This application is based on patent application No. 2005-345701 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet bending apparatus for performing a center-folding processing to a stack of a plurality of recording sheets which are placed in a sheet holding member and whose both side ends are aligned, the center-folding processing being performed in a vicinity of a central portion in a sheet conveyance direction of the sheet holding member, the sheet bending apparatus comprising:

a pair of upper side end aligning members positioned on upstream in the sheet conveyance direction on the sheet holding member and being movable equally in opposite width directions of the sheet holding member, the width directions being transverse to the sheet conveyance direction;

a pair of lower side end aligning members positioned on downstream in the sheet conveyance direction on the sheet holding member and being movable equally in opposite width directions of the sheet holding member and independently from the upper side end aligning members;

a pair of center-folding rollers and a bending blade facing each other and positioned in a vicinity of a central portion in the sheet conveyance direction of the sheet holding member; and a restricting member movable along a sheet conveyance path of the sheet holding member, wherein the pair of upper side end aligning members approach from opposite width sides of the sheet placed in the sheet holding member on upstream of the pair of center-folding rollers and the bending blade;

the pair of lower side end aligning members approach from opposite width sides of the sheet placed in the sheet holding member on downstream of the center-folding rollers and the bending blade;

the upper side end aligning members and the lower side end aligning members align the side ends of the recording sheet placed in the sheet holding member in a state where the recording sheet is restricted by the restricting member.

2. A sheet bending apparatus according to claim 1, wherein:

each of the pair of the upper side end aligning member includes:

a side wall portion standingly provided on one of the opposite side ends of the sheet holding member, the side wall portion extending along the sheet conveyance direction; and a top wall portion extending inward substantially perpendicularly from an end of the side wall portion toward the sheet holding member, the top wall portion having an upstream end portion rising upward.

3. A sheet bending apparatus according to claim 1, further comprising:

an upper side end aligning driver for driving the pair of upper side end aligning members so that the upper side end aligning members approach the recording sheet placed in the sheet holding member; and a lower side end aligning driver for driving the pair of lower side end aligning members so that the upper side end aligning members approach the recording sheet placed in the sheet holding member, wherein the upper side end aligning driver and the lower side end aligning driver drive the upper side end aligning members and the lower side end aligning members in a state where the restricting member restricts the recording sheet placed in the sheet holding member.

4. A sheet bending apparatus according to claim 1, further comprising a supporting member which supports a tailing end of the recording sheet placed in the sheet holding member and is movable along the sheet conveyance path on the sheet holding member, wherein the restricting member and the supporting member are movable in a state where the restricting member comes in contact with a leading end of the recording sheet and the supporting member comes in contact with the tailing end of the recording sheet.

5. A sheet bending apparatus according to claim 4, further comprising:

a restricting member driver for driving the restricting member; and a supporting member driver for driving the supporting member, wherein:

the restricting member driver and the supporting member driver drive the restricting member and the supporting member in a state where the restricting member comes in contact with the leading end of the recording sheet and the supporting member comes in contact with the tailing end of the recording sheet.

6. A sheet bending apparatus according to claim 1, further comprising a center-binding stapler provided between the upper side end aligning members and the pair of center-folding rollers and the bending blade for performing a center-binding processing to the recording sheet placed in the sheet holding member.

7. A sheet postprocessing apparatus comprising:

a main body connected to an image forming apparatus;

the sheet bending apparatus of claim 1 provided in the main body; and a conveying portion for conveying the recording sheet formed with an image by the image forming apparatus to the sheet holding member.

* * * * *